US006716056B1

(12) United States Patent
Hsu

(10) Patent No.: US 6,716,056 B1
(45) Date of Patent: Apr. 6, 2004

(54) CONNECTOR

(75) Inventor: Ferry Hsu, Taoyuan Hsien (TW)

(73) Assignee: Component User Industry Co., LTD (TW)

( * ) Notice: Subject to any disclaimer, the term of this patent is extended or adjusted under 35 U.S.C. 154(b) by 0 days.

(21) Appl. No.: 10/638,896

(22) Filed: Aug. 12, 2003

(51) Int. Cl.[7] ..... H01R 4/24
(52) U.S. Cl. ..... 439/417; 439/406
(58) Field of Search ..... 439/417, 406, 439/402, 403, 404, 405, 449, 420, 501

(56) References Cited

U.S. PATENT DOCUMENTS 4,781,615 A * 11/1988 Davis et al. ..... 439/395
5,498,172 A * 3/1996 Noda ..... 439/404
5,855,492 A * 1/1999 Abe et al. ..... 439/417
6,328,592 B1 * 12/2001 Burke et al. ..... 439/417
6,579,115 B2 * 6/2003 Mitsugi ..... 439/417

* cited by examiner

*Primary Examiner*—Tho D. Ta
*Assistant Examiner*—James R. Harvey

(57) ABSTRACT

A connector mainly includes a plurality of terminals, each of which includes a front conductive section and a rear piercing section; a plastic housing being provided at a front part with internal terminal slots for receiving the conductive sections of the terminals therein and at an open rear part with passages for receiving the piercing sections of the terminals; and an upper cover for closing the open rear part of the plastic housing. The upper cover is closed to the open rear opening of the plastic housing to press a plurality of wires against the piercing sections located in the passages on the plastic housing, so that insulating skins of the wires are cut to allow electrical connection of conductors in the wires with the terminals without the need of soldering.

6 Claims, 4 Drawing Sheets

CONNECTOR

FIELD OF THE INVENTION

The present invention relates to a connector, and more particularly to a connector in which an upper cover is closed to an open rear opening of a plastic housing to press a plurality of wires against piercing sections of terminals located in passages provided on the plastic housing, so that insulating skins of the wires are cut to allow electrical connection of conductors in the wires with the terminals without the need of soldering, and time and cost for assembling the connector are reduced.

BACKGROUND OF THE INVENTION

With the highly developed technologies, computers have been designed to execute more and more advanced functions. In other words, the central processing unit (CPU) inside each computer has incredibly high digital operating capability. Moreover, with the popularization of Internet, users demand for even faster upload and download speeds via the use of, for example, optical fibers, broad bands, asymmetric/asynchronous digital subscriber line (ADSL), etc. Under this condition, all other peripherals of the computer system, including various kinds of driving and driven elements, must also have a high operating speed corresponding to the high-speed CPU. For this purpose, it is very important for signal transmission cables, particularly connectors provided at two ends of the cables, to transmit signals between the CPU and the various driving and driven elements at a very high speed. It is also known that there are many devices, such as the universal serial bus (USB), the cable connectors, etc., being provided with an externally connected bus that supports a transmission rate as high as 12 Mbps with each port thereof capable of connecting up to 127 devices at the same time, as well as the functions of plug-and-play and hot-plugging.

FIGS. 1 and 2 are perspective and sectioned side views, respectively, of a conventional connector to show the assembling thereof. As shown, the conventional connector includes a plastic core 1, a plurality of terminals 2, and a plurality of wires 3.

The plastic core 1 is internally provided with a plurality of equally spaced terminal holes that extend from a front to a rear end of the plastic core 1. A flat plate 11 is rearward extended from the rear end of the plastic core 1, and a plurality of terminal slots are formed on the flat plate 11 corresponding to the terminal holes. Each of the terminals 2 is in the form of a flat strip divided into a bent front conductive section 21 and a rear soldering section 22. The terminals 2 are provided on a main body thereof with barbs. Each of the wires 3 has a bare front end 31.

To assemble the terminal 2 to the plastic core 1, the conductive section 21 of the terminal 2 is inserted into one terminal hole from a rear end of the plastic core 1, so that the soldering section 22 of the terminal 2 is positioned in a corresponding terminal slot on the flat plate 11. When the terminal 2 is inserted into the plastic core 1, the barbs on the body of the terminal 2 are forced into the terminal hole to hook to inner wall surfaces of the terminal hole, making the terminal 2 fixedly located in the terminal hole. The soldering section 22 of the terminal 2 is exposed from the rear end of the plastic core 1 for the bare front end 31 of the wire 3 to overlap thereat. Thereafter, the bare front end 31 of the wire 3 is manually soldered to the soldering section 22 of the terminal 2 using soldering iron and soldering stick. Finally, a molding machine (not shown) is used to integrally mold a plastic case 4 around the wires 3 and the plastic core 1 to complete the connector.

During the process of soldering the terminals 2 to the wires 3, since the terminals 2 have been previously inserted into the plastic core 1, the high temperature of the soldering iron tends to deform the plastic core 1 to therefore adversely affect the quality of the produced connector. Moreover, in the conventional connector, the terminals 2 are forced into and hooked to the plastic core 1 to thereby locate in the connector. To enable the terminals 2 to firmly hook to the plastic core 1, it is necessary to provide barbs on two sides of the terminals 2. In forming the terminals 2 with barbs, increased amount of scrap is produced when punching the material strips to form the terminals 2. In assembling the conventional connector, the terminals 2 must be accurately inserted into the terminal holes in the plastic core 1 with a properly controlled insertion force to avoid biased or deformed terminals 2. Moreover, an additional mold must be made to produce the plastic case 4 for integrally and tightly enclosing and fixing the wires 3, the terminals 2, and the plastic core 1 together. The mold would inevitably increase the manufacturing cost of the conventional connector to adversely reduce the competition ability of the connector in the international markets.

It is therefore tried by the inventor to develop a connector to eliminate drawbacks existed in the conventional connector, so that the connector may be quickly assembled to reduce the manufacturing cost thereof.

SUMMARY OF THE INVENTION

A primary object of the present invention is to provide a connector in which an upper cover is closed to an open rear opening of a plastic housing to press a plurality of wires against piercing sections of terminals located in passages provided on the plastic housing, so that insulating skins of the wires are cut to allow electrical connection of conductors in the wires with the terminals without the need of soldering, and time and cost for assembling the connector are reduced.

To achieve the above and other objects, the connector of the present invention mainly includes a plurality of terminals, each of which includes a front conductive section and a rear piercing section; a plastic housing being provided at a front part with internal terminal slots for receiving the conductive sections of the terminals therein and at an open rear part with passages for receiving the piercing sections of the terminals; and an upper cover for closing the open rear part of the plastic housing. The upper cover is closed to the open rear opening of the plastic housing to press a plurality of wires against the piercing sections located in the passages on the plastic housing, so that insulating skins of the wires are cut to allow electrical connection of conductors in the wires with the terminals without the need of soldering.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
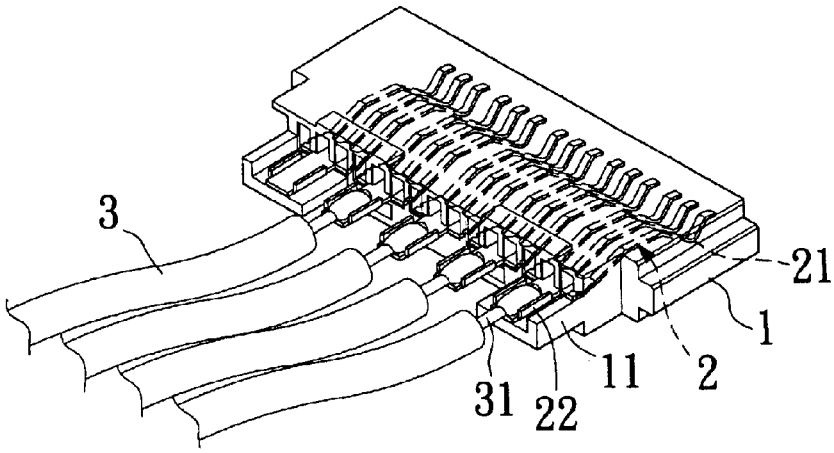
(PRIOR ART) Fig. 1
FIG. 1 is a perspective view showing the assembling of a conventional connector.
Figure 2:
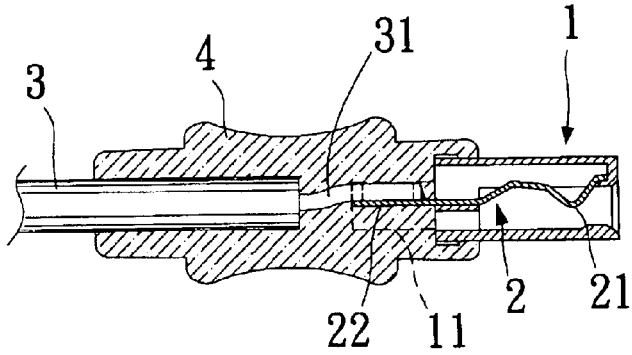
(PRIOR ART) Fig. 2
FIG. 2 is a sectioned side view of FIG. 1.
Figure 3:
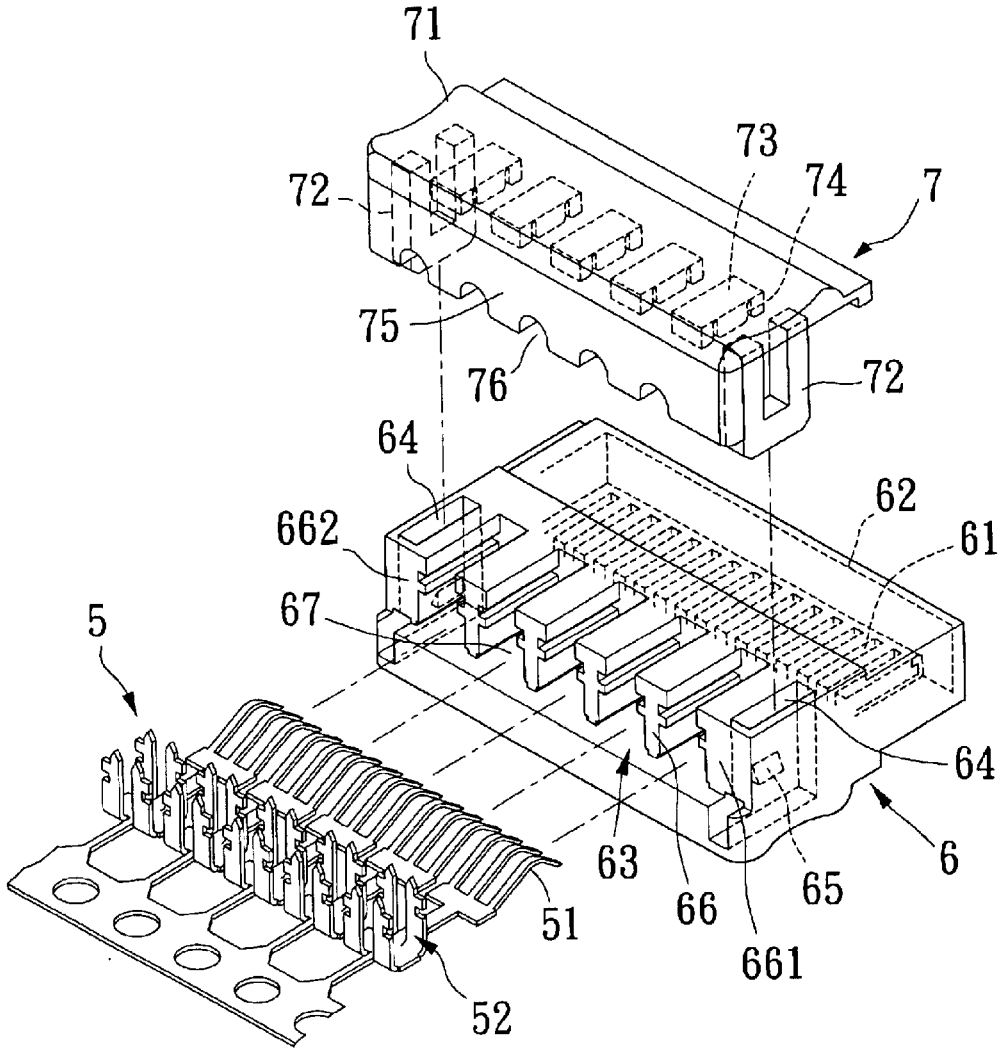
FIG. 3 is an exploded perspective view of a connector according to the present invention.
Figure 4:
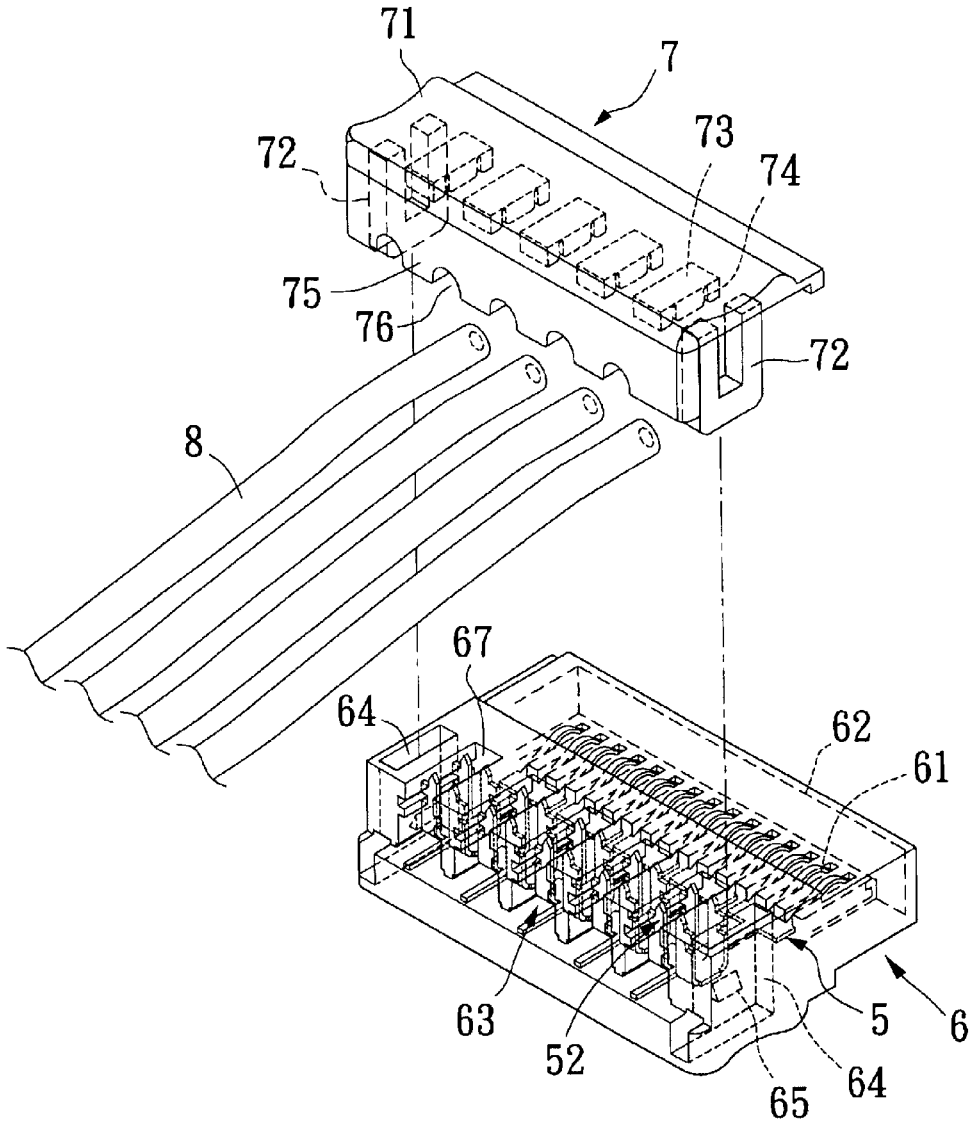
FIG. 4 is a partially assembled perspective view of FIG. 3 showing the connection of wires to the connector of the present invention.
Figure 5:
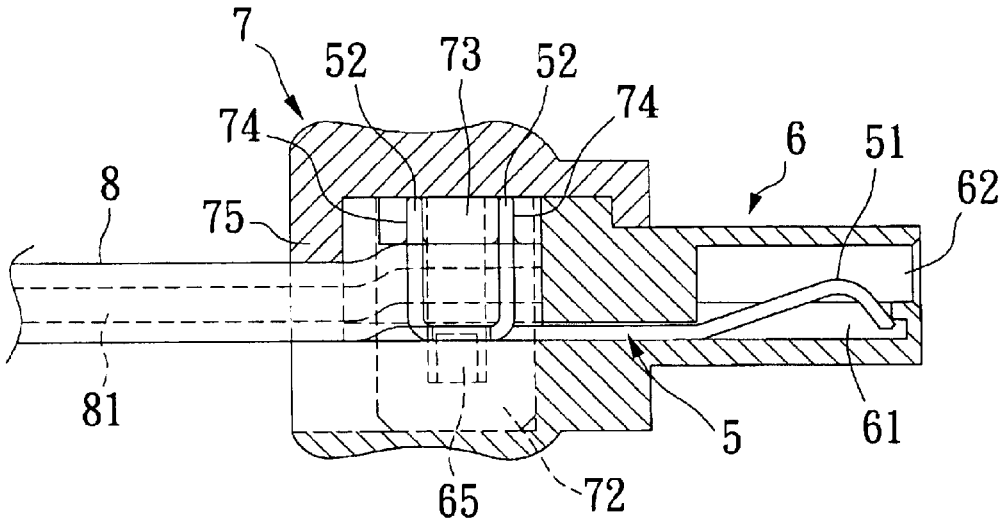
FIG. 5 is a sectioned side view of the connector of the present invention.

Please refer to FIGS. 3, 4 and 5 which are exploded perspective, partially assembled perspective, and sectioned side views, respectively, of a connector according to the present invention. As shown, the connector mainly includes a plurality of terminals 5, a plastic housing 6, and an upper cover 7.

Each of the terminals 5 includes a front half formed into a conductive section 51 having a horizontal and elastically bent configuration, and a rear half formed into a vertical two-bladed piercing section 52 having pointed upper ends. The piercing section 52 has two substantially crenellated lateral outer edges, and two inner edges adapted to cut two sides of an insulating skin of a wire 8 to firmly clamp on and electrically connect with a conductor 81 inside the insulating skin. Alternatively, the piercing section 52 of the terminal 5 may be of one-bladed to cut only one side of the insulating skin of the wire 8. In this case, the piercing section 52 works with a dividing wall 66 to firmly clamp on and electrically connect with the conductor 81 inside the insulating skin.

The plastic housing 6 is internally preformed with a plurality of terminal slots 61, into each of which the conductive section 51 of one terminal 5 is positioned. A front end of the plastic housing 6 is an opening 62, into which another corresponding connector is plugged to electrically connect to the conductive sections 51 of the terminals 5. A rear part of the plastic housing 6 is formed into an open-topped rear opening 63. The rear opening 63 is provided at the tops of two sidewalls with two downward extended locating slots 64. A retaining block 65 is provided on an inner surface of an inner sidewall of each locating slot 64. A plurality of vertical dividing walls 66 are equally spaced between the two locating slots 64 to form a passage 67 between any two adjacent dividing walls 66. Two outmost ones of the dividing walls 66 are denoted with reference numerals of 661 and 662, and respectively have a crenellated inner surface, with which the lateral outer edges of the piercing sections 52 of the two outmost terminals 5 form two complementary pairs. Each of the intermediate dividing walls 66 is located between two adjacent piercing sections 52 of the terminals 5 and has two crenellated lateral surfaces complementary to the crenellated lateral outer edges of the piercing sections 52. Therefore, the terminals 5 with the two-bladed piercing sections 52 having crenellated lateral outer edges may be fitly slid into the passages 67 on the plastic housing 6.

The upper cover 7 includes a horizontal top plate 71 for correspondingly closing the open top of the rear opening 63 of the plastic housing 6, and a vertical back wall 75 downward extended from a rear edge of the top plate 71. Two generally U-shaped locating blocks 72 are downward extended from two rear outer ends of the top plate 71 for inserting into the locating slots 64 on the plastic housing 6 to be held thereto by the retaining blocks 65. A plurality of hold-down blocks 73 are spaced at an underside of the top plate 71 between the two locating blocks 72 to correspond to the passages 67 on the plastic housing 6. Each of the hold-down blocks 73 is provided at a lower surface with upward extended engaging slots 74 for engaging with the pointed tops of the piercing sections 52 of the terminals 5, such that the lower surface of each hold-down block 73 is divided into three parts that have bottoms flush with one another. The back wall 75 is provided at a lower edge with a plurality of curved recesses 76, so that the back wall 75 correspondingly covers the rear opening 63 of the plastic housing 6 with the curved recesses 76 pressed against wires 8 separately clamped between two blades of each piercing section 52.

Figure 6:
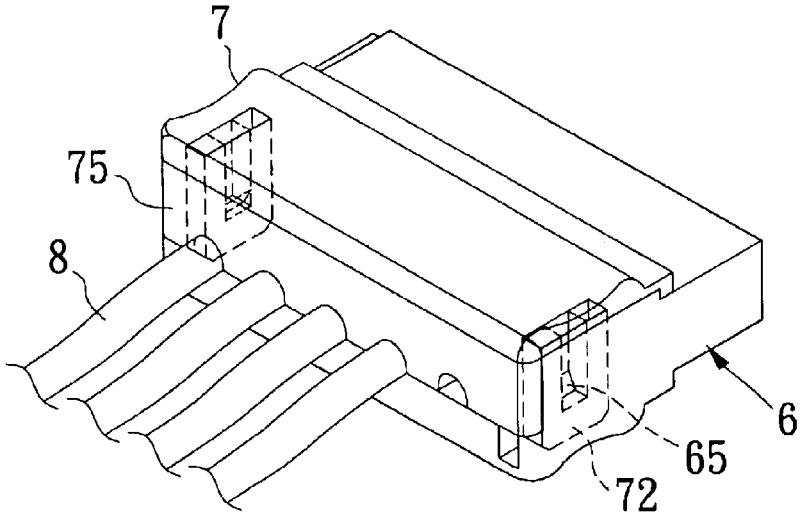
FIG. 6 is an assembled perspective view of the connector of the present invention.

With the above arrangements, the terminals 5 may be directly and quickly positioned into the terminal slots 61 in the plastic housing 6, as shown in FIGS. 4 and 5. The wires 8 are directly laid on the passages 67 on the plastic housing 6 before the upper cover 7 is correspondingly closed onto the rear opening 63 of the plastic housing 6 with the locating blocks 72 fitly inserted into the locating slots 64. The hold-down blocks 73 at the underside of the upper cover 7 closed onto the rear opening 63 would force the wires 8 into the piercing sections 52 of the terminals 5, so that the insulating skins of the wires 8 are pierced through by the piercing sections 52 and the internal conductors 81 of the wires 8 are firmly clamped between and electrically connected with two blades of the piercing sections 52. Front ends of the wires 8 are not only held down in place by the hold-down blocks 73 beneath the top plate 71 of the upper cover 7, but also confined to the curved recesses 76 at the lower edge of the back wall 75 of the upper cover 7. In this manner, the terminals 5 and the wires 8 are electrically connected to one another to complete the connector of the present invention without the need of soldering them together, as shown in FIG. 6, so that the connector may be quickly assembled at reduced cost.

In brief, the wires 8 are pressed against the terminals 5 by the hold-down blocks 73 and the back wall 75 when the upper cover 7 is closed onto the plastic housing 6. In this manner, the wires 8 are firmly pressed against the plastic housing 6 by the upper cover 7, and the terminals 5 may be positioned in the passages 67 and the terminal slots 61 in the quickest possible way without the need of forming barbs at two sides of the terminals as in the prior art. With the barbs being omitted, the terminals 5 may be directly punched from a long material strip with minimized scraps, some of which may still be utilized. Since the terminals 5 are directly positioned into the terminal slots 61, they are not subjected to twist and deformation. Meanwhile, it is not necessary to additionally provide a plastic case for locating wires and plastic core as in the prior art. Therefore, the connector of the present invention may be manufactured at reduced cost and increased productivity to improve its competition ability in international markets.

What is claimed is:

1. A connector comprising a plurality of terminals, a plastic housing, and an upper cover;

each of said terminals including a front half formed into a generally horizontal conductive section having an elastically bent configuration, and a rear half formed into a vertical piercing section having pointed upper ends;

said plastic housing being internally preformed with a plurality of terminal slots, into each of which said conductive section of one said terminal is positioned; a front end of said plastic housing being an opening, into which another corresponding connector is plugged to electrically connect with said conductive sections of said terminals; a rear part of said plastic housing being formed into an open-topped rear opening, said rear opening being provided at upper ends of two sidewalls with two downward extended locating slots, a retaining block being provided on an inner surface of an inner sidewall of each said locating slot; and a plurality of vertical dividing walls being equally spaced between said two locating slots to form a passage between any two said dividing walls that are adjacent to each other, so that said piercing sections of said terminals may be slid into said plastic housing via said passages; and said upper cover including a horizontal top plate for correspondingly closing the open top of said rear opening of said plastic housing, and a vertical back wall downward extended from a rear edge of said top plate for closing said rear opening of said plastic housing; two locating blocks being downward extended from two rear outer ends of said top plate for inserting into said locating slots on said plastic housing to be held thereto by said retaining blocks; a plurality of hold-down blocks being spaced at an underside of said top plate between said two locating blocks to correspond to said passages formed on said plastic housing, each of said hold-down blocks being provided at a lower surface with upward extended engaging slots for engaging with said pointed tops of said piercing sections of said terminals; and said back wall being provided at a lower edge with a plurality of curved recesses for confining and pressing wires against said piercing sections of said terminals.

2. The connector as claimed in claim 1, wherein said piercing section of said terminal includes two blades for cutting two sides of an insulating skin of one wire positioned between said two blades and then clamping on and electrically connecting with a conductor inside said insulating skin.

3. The connector as claimed in claim 1, wherein said piercing section of said terminal includes only one single blade for cutting one side of an insulating skin of one wire positioned on said terminal, and then working with one of said dividing walls opposite to said blade to clamp on and electrically connect with a conductor inside said insulating skin.

4. The connector as claimed in claim 1, wherein two outmost ones of said dividing walls on said plastic housing respectively have a crenellated inner surface, and other intermediate ones of said dividing walls respectively have two crenellated outer surfaces; and wherein each of said piercing sections of said terminals includes two blades and has two crenellated lateral outer edges complementary to said crenellated surfaces of said diving walls; whereby said terminals may be separately fitly slid into said passages between said dividing walls on said plastic housing.

5. The connector as claimed in claim 1, wherein said locating blocks provided at two outer ends of said upper cover are substantially U-shaped.

6. The connector as claimed in claim 1, wherein each of said hold-down blocks provided at the underside of said upper cover is divided into three parts that have bottoms flush with one another.

* * * * *